United States Patent [19]

Minoura

[11] Patent Number: 4,826,150

[45] Date of Patent: May 2, 1989

[54] RESISTANCE APPLYING MEANS FOR EXERCISING APPARATUS

[75] Inventor: Chihiro Minoura, Gifu, Japan

[73] Assignee: Minoura Carrier & Stand Works Co., Ltd., Gifu, Japan

[21] Appl. No.: 173,017

[22] Filed: Mar. 22, 1988

Related U.S. Application Data

[63] Continuation of Ser. No. 882,666, Jul. 7, 1986, abandoned.

[30] Foreign Application Priority Data

Feb. 20, 1986 [JP] Japan ..... 61-36744

[51] Int. Cl.[4] ..... A63B 23/04; H02K 49/00

[52] U.S. Cl. ..... 272/73; 272/129; 310/103; 310/105

[58] Field of Search ..... 272/73, 129, DIG. 5, 272/DIG. 6, 116, 130; 310/103, 92, 93, 105, 52, 58, 60 A; 73/862.17

[56] References Cited

U.S. PATENT DOCUMENTS

| | | | |
|---|---|---|---|
| 3,442,131 | 5/1969 | Leyten | 272/73 |
| 3,831,942 | 8/1974 | Del Mar | 272/73 |
| 4,152,617 | 5/1979 | Janson | 310/103 |
| 4,441,705 | 4/1984 | Brown | 272/73 |
| 4,602,373 | 7/1986 | Dorfman | 272/73 |

FOREIGN PATENT DOCUMENTS

| | | | |
|---|---|---|---|
| 0176962 | 4/1986 | European Pat. Off. | 272/73 |
| 1279201 | 6/1972 | United Kingdom | 272/73 |

*Primary Examiner*—Richard J. Apley
*Assistant Examiner*—S. R. Crow
*Attorney, Agent, or Firm*—Jordan and Hamburg

[57] ABSTRACT

A resistance applying mechanism for use in an exercising apparatus having a support frame on which a bicycle provided with at least a saddle and foot pedals is supported includes a rotary shaft rotatably supported by the support frame and driven by operating the foot pedals; a rotating disk made of metal and fixed to the rotary shaft; and at least a pair of permanent magnets for generating an eddy current placed opposite each other with the rotating disk interposed therebetween.

3 Claims, 4 Drawing Sheets

RESISTANCE APPLYING MEANS FOR EXERCISING APPARATUS

This application is a continuation of application Ser. No. 882,666, filed July 7, 1986 now abandoned.

BACKGROUND OF THE INVENTION

The present invention relates to an exercising apparatus which enables the user to enjoy exercise similar to the actual riding of a bicycle by sitting on the saddle of a stationary bicycle provided on a support frame and rotating the foot pedals. More particularly, the invention relates to means for applying load resistance to the foot pedals of such an exercising apparatus.

The resistance applying means disclosed in U.S. Pat. No. 4,441,705 comprises a disk-like frictional braking device mounted on a rotary shaft which is driven by the rear wheel of a bicycle; and a cage fan unit provided on the rotary shaft whereby the air resistance is increased and decreased depending upon the rotational speed of the rear wheel. A centrifugal control device is connected to the braking device so that the frictional resistance brought about by the braking device depending upon the speed of the rear wheel can be controlled automatically.

However, in this conventional means, the load resistance is reduced as the friction means, such as a lining or pads in the braking device, wears out. Thus, the friction means must be replaced at an early stage, which involves a troublesome maintenance. This means also experiences the problem that air is disturbed with the rotation of the fan and a loud noise is thus generated during use, as well as dust being flung up. The centrifugal control device employed for controlling the load resistance also has the disadvantage of leading to complication of the entire structure of the resistance applying means.

SUMMARY OF THE INVENTION

It is an object of the invention to provide a resistance applying means for an exercising apparatus which is capable of continually applying a stable load resistance for a long period.

It is another object of the invention to provide a resistance applying means which enables an exercising apparatus to be comfortably used without generating a loud noise and flinging up dust.

It is further object of the invention to provide a resistance applying means for an exercising apparatus which is capable of easily constructing a mechanism for providing load resistance.

In order to attain the above-mentioned objects, a resistance applying means for an exercising apparatus of the invention comprises a support frame on which a bicycle provided with at least a saddle and foot pedals is supported; a rotary shaft which is rotatably supported by the support frame and is driven by operating the foot pedals; a rotating disk which is made of metal and is fixed to the rotary shaft; and at least a pair of permanent magnets for generating eddy current placed such as to face each other with the rotating disk interposed therebetween.

Other and further objects of this invention will become apparent from the illustrative embodiments to be described, and various advantages not referred to herein will occur to one skilled in the art upon employment of the invention in practice.

DETAILED DESCRIPTION OF THE PREFERRED EMBODIMENTS

An embodiment of this invention will now be described in detail with reference to the drawings.

Figure 1:
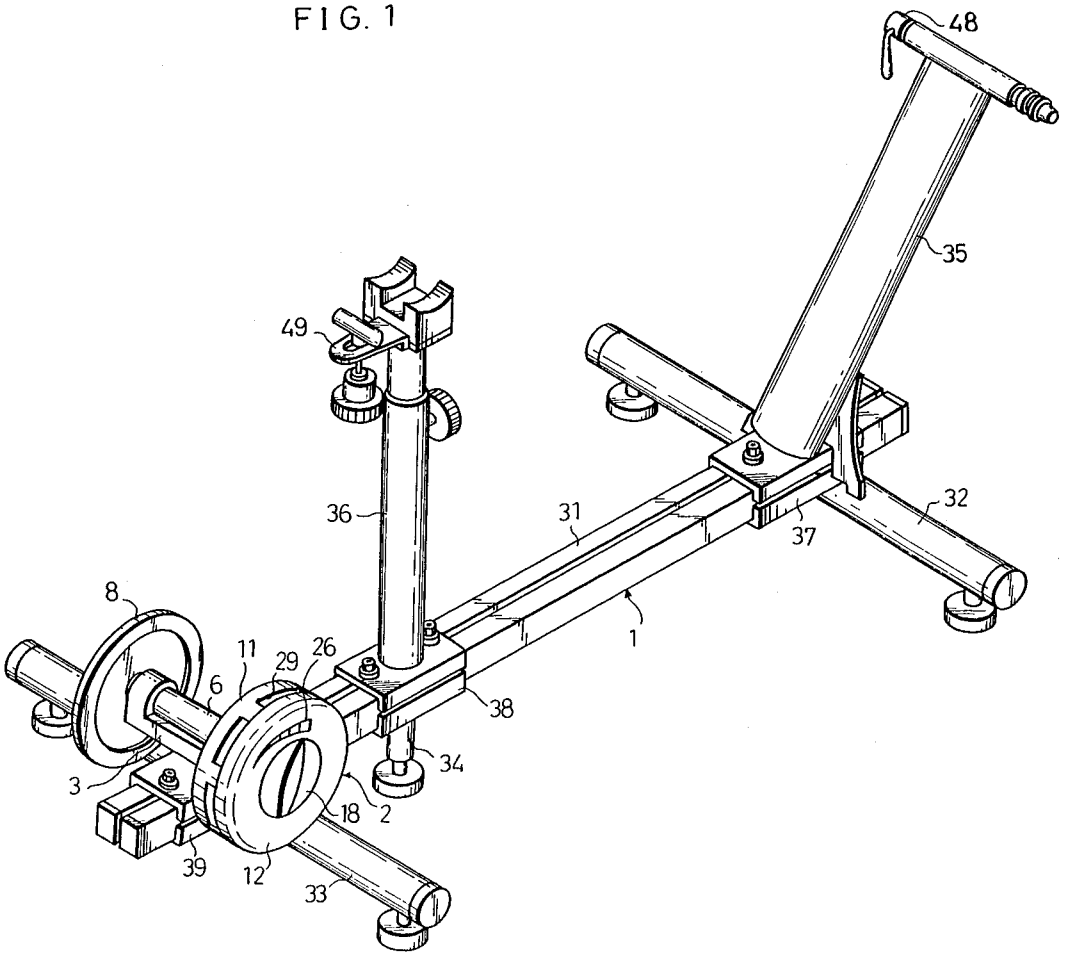
FIG. 1 is a perspective drawing which shows the support frame of an exercising apparatus provided with the resistance applying means of this invention.
Figure 2:
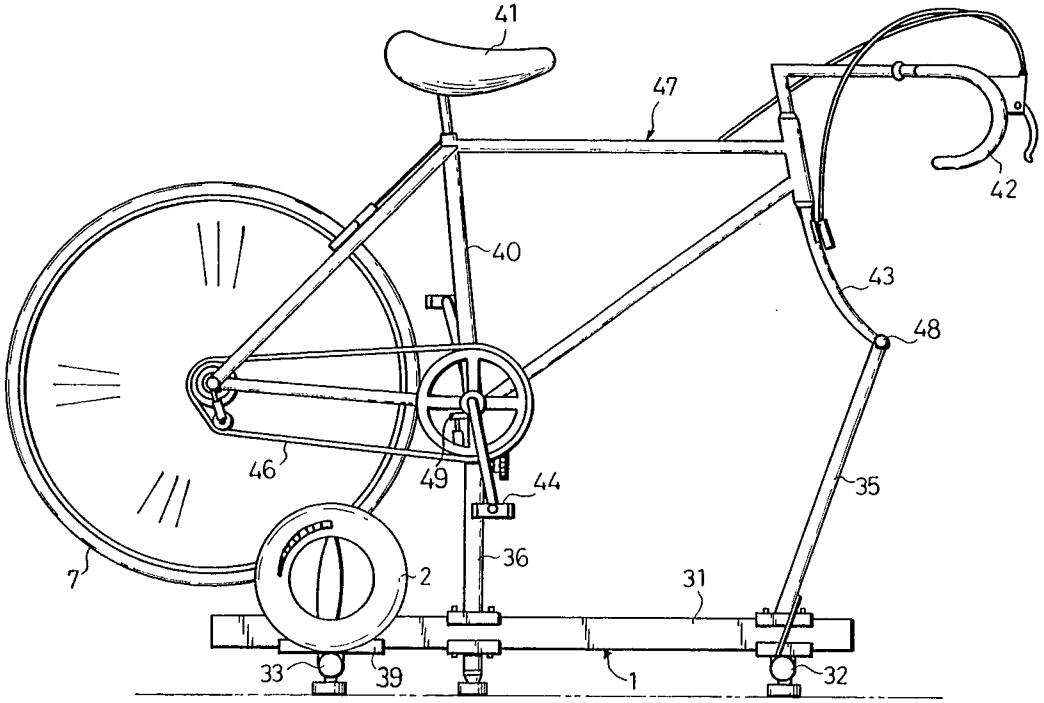
FIG. 2 is a side view showing an entire exercising apparatus in which a bicycle frame without a front wheel is provided on a support frame.

As shown in FIGS. 1 and 2, the support frame 1 comprises a longitudinally extending main frame member 31, front and rear stabilizer frame members 32, 33 which intersect the main frame member 31 at right angles, a central supporting foot 34, an obliquely angled front support member 35, and an elastic rear support member 36. The front stabilizer frame member 32 and the front support member 35 are mounted on the main frame member 31 through a front slider 37 whereby it is possible for their positions to be adjusted in the longitudinal direction. The central supporting foot 34 and the rear support member 36 are supported by the main frame member 31 through the central slider 38 such that their positions can be adjusted in the longitudinal direction. The rear stabilizer frame member 33 is mounted on the main frame member 31 through the rear slider 39 such that its position can be adjusted in the longitudinal direction.

Mounted on the support frame 1 is a bicycle 47 provided with a vertical frame member 40, a saddle 41, a handle bar 42, a front wheel fork 43, foot pedals 44, a rear wheel 7, and a rear wheel driving means 46, etc. The lower end of the front wheel fork 43 which has no front wheel attached is fixedly supported by a connecting member 48 provided on the upper end of the front support member 35 of the support frame 1. The lower end of the vertical frame 40 is fixed to a fastening member 49 mounted at the upper end of the rear support member 36 of the support frame 1. The rear wheel 7 of the bicycle 47 is loaded on a resistance applying means 2 which is mounted on the upper surface of the rear slider 39 of the support frame 1.

The structure of the, resistance applying means 2 will be now explained with reference to FIGS. 3 to 5.

Figure 3:
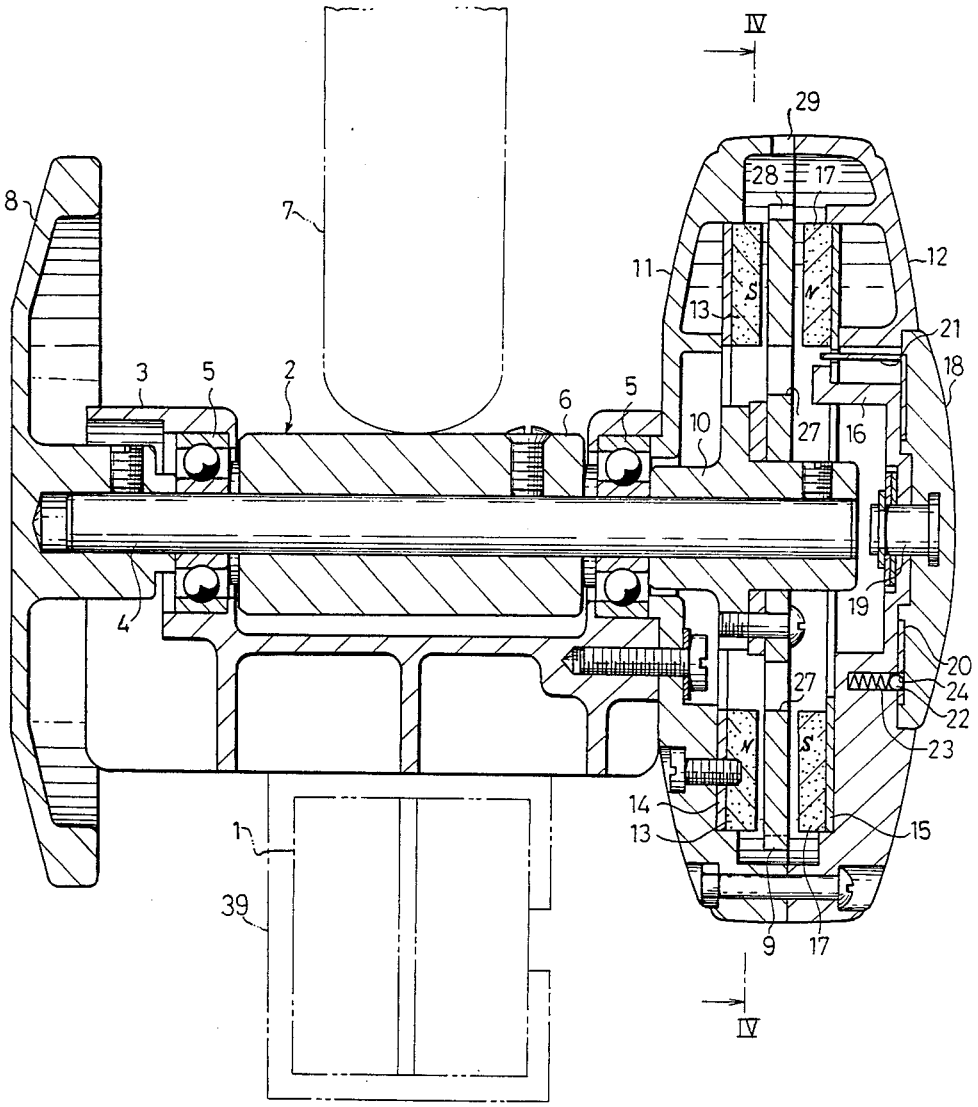
FIG. 3 is a sectional view of a resistance applying means for an exercising apparatus which illustrates an embodiment of this invention.

As shown in FIG. 3, a rotary shaft 4 is rotatably supported by a bracket 3, which is fixed to the upper surface of the rear slider 39, through two bearings 5. A driving cylinder 6 is engaged around the center of the rotary shaft 4 and rear wheel 7 of the exercising apparatus is maintained in contact with the external circumference thereof. The rotary shaft 4 is such as to be rotated by the rotation of the rear wheel 7, accompanying the rotating operation of the foot pedals 44 of the bicycle 47, through the driving cylinder 6.

A balancer 8 is fixed to one end of the rotary shaft 4 by mutual engagement and a rotating disk 9 made of metal (in the embodiment, aluminum) is fixed to the other end through a bush 10 by mutual engagement. This rotating disk 9 is smoothly rotated in equilibrium with the balancer 8. An approximately cup-shaped internal case 11 is fixed to the side surface of the bracket 3 such as to cover the rotating disk 9 from one side thereof and an approximately cup-shaped external case 12 is mounted on the open side of the internal case such as to cover the rotating disk 9 from the other side thereof.

A plurality (in the embodiment, (6) of permanent magnets 13 on the fixed side are provided on the inside surface of the internal case 11 through mounting disk 14 such that they are concyclically arranged at equal intervals in the vicinity of the one side surface of the rotating disk 9. The permanet magnets 13 on the fixed side are arranged such that the polarities of the side surface opposite to the rotating disk 9 are alternately different from the adjacent ones in the circumferential direction, as shown in FIGS. 3 and 4.

A supporting disk 15 is rotatably supported by the inside surface of the external case 12 and is held stationary by a plurality of supporting legs 16 provided on the external case 12. A plurality (in the embodiment, (6) of permanent magnets 17 on the movable side are mounted on the supporting disk 15 such that they are concyclically arranged at equal intervals in the vicinity of the other side surface of the rotating disk 9 in the state of facing the permanent magnets 13 on the fixed side. The permanent magnets 17 on the movable side are arranged such that the polarities of the side surfaces opposite to the rotating disk 9 are alternately different from the adjacent ones and that an eddy current is generated on the rotating disk 9 by the cooperation with the permanent magnets 13 on the fixed side during the rotation of the rotating disk 9.

An adjusting handle 18, which acts as a manual operation member, is rotatably provided on the center of the outside surface of the external case 12 through a pin 19 and is connected to the supporting disk 15 through a plurality of connecting pieces 21 on a connecting disk 20 fixed to the inside surface of the handle. An engaging ball 22 and a spring 23 are provided on the outside surface of the external case 12 so that the permanent magnets 17 on the movable side are held in desired adjusting positions by selectively engaging the ball 22 in a plurality of engaging holes 24 provided on the connecting disk 20 by means of the function of the spring 23 when the positions of the permanent magnets 17 on the movable side are changed and adjusted by rotating the supporting disk 15 with the adjusting handle 18.

Figure 5:
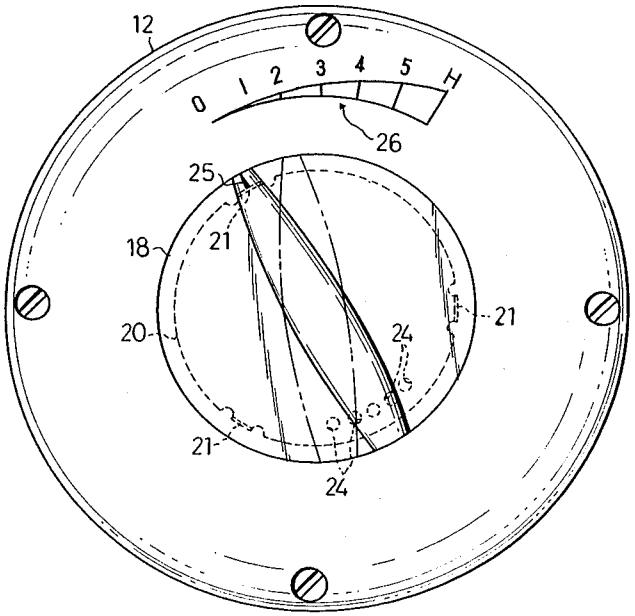
FIG. 5 is a right side view of the resistance applying means of this invention as shown in FIG. 3.

As shown in FIG. 5, an index 25 is provided on the outside surface at one end of the handle portion of the adjusting handle 18 and an indicating portion 26 for indicating the adjusting positions of loads is provided on the outside surface of the external case, corresponding to the index 25. These are constructed as follows: When the adjusting handle 18 is rotated to the position in which the index 25 indicates "0" on the indicating portion 26, the permanent magnets 17 on the movable side are coordinatedly arranged in a state in which the polarities of the side surfaces are the same as those of the permanent magnets 13 on the fixed side opposite thereto and the eddy current generated during the rotation of the rotating disk 9 becomes zero. By rotating clockwise the adjusting handle 18 shown in FIG. 5 from this state, the facing positions of the permanent magnets 17 on the movable side are displaced in order from the position with the same polarity to an adjacent position with a different polarity with respect to the permanent magents 13 on the fixed side opposite thereto, in the circumferential direction, the eddy current thereby being gradually increased. When the adjusting handle 18 is rotated to the position in which the index 25 indicates "H" on the indicating portion 26, the permanent magnets 17 on the movable side are coordinatedly arranged in a state in which the polarities of the side surfaces are different from those of the permanent magnets 13 on the fixed side opposite thereto, the eddy current thus reaching its maximum value.

Figure 4:
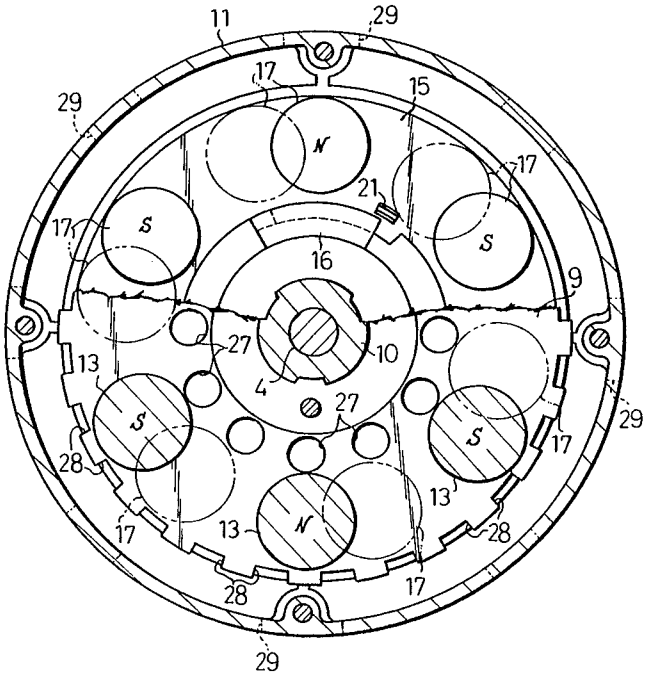
FIG. 4 is a sectional view taken along the line IV—IV in FIG. 3 which shows the configuration of permanent magnets.

Furthermore, in this embodiment, as shown in FIGS. 3 and 4, a large number of through holes 27 and convex and concaves 28 are formed on the rotating disk 9 and a plurality of openings 29 are formed on the external circumference of the internal case 11 so that a small degree of air resistance is supplementarily applied to the rotating disk 9 during the rotation thereof and a light load is applied to the foot pedals 44 even if the eddy current is adjusted and set at zero.

The function of the exercising apparatus constructed in accordance with the above description will next be explained.

In this exercising apparatus, when the rear wheel 7 is rotated by the rotating operation of the foot pedals 44 with the user sitting on the saddle 41, the rotary shaft 4 is rotated through the driving cylinder 6 and the balancer 8 and the rotating disk 9 at both ends are smoothly rotated as a unit. During this rotation, the permanent magnets 13 and 17 on the fixed and the movable sides are placed opposite to each other with the rotating disk 9 between them and an eddy current is thus generated on the rotating disk 9 such as to apply resistance to the rotation thereof, with a load thereby being applied to the rotating operation of the pedals 44. The load caused by the eddy current is different from that caused by the braking device and does not decrease even with use over a long period. Therefore, it is possible to exercise in a room in the same manner as when pedalling a bicycle by rotating the foot pedals 44. Since the air is not disturbed by the rotation of the balancer 8 and the rotating disk 9 in this exercising apparatus, it is possible to use this exercising apparatus comfortably without generating any noise and flinging up dust.

In addition, the magnitude of the eddy current generated on the rotating disk 9 in this exercising apparatus is changed by varying the positions of the permanent magnets 17 on the movable side facing those 13 on the fixed side by rotating the adjusting handle 18 so that the load applied to the rotating operation of the foot pedals 44 can be easily adjusted. Therefore, this apparatus can be used at a desired load condition by adjusting and setting the load in accordance with the physical strength of the user, etc.

This invention is not limited to the configuration of the above-mentioned embodiment and may, for example, be so constructed that the rotary shaft 4 is rotated by the rotating operation of the foot pedals 44 through a chain, etc, and the rotating disk 9 and the permanent magnets 13 and 17 may be provided on both ends of the rotary shaft 4.

As many apparently widely different embodiments of this invention may be made without departing from the spirit and scope thereof, it is to be understood that the invention is not limited to the specific embodiments thereof except as defined in the appended claims.

What is claimed is:

1. A resistance applying means for an exercising apparatus having a support frame on which a bicycle provided with at least a saddle and foot pedals is supported, comprising a rotary shaft rotatably supported by said support frame and driven by operating said foot pedals; a rotating metal disk having a circumference, a plurality of alternating convex and concave portions along the circumference and a plurality of through holes and being fixed to said rotary shaft; a plurality of permanent magnets fixed opposite the circumference of said rotating disk at equal intervals and having polarities alternately different from each other; a plurality of permanent magnets provided opposite the circumference of said rotating disk at equal intervals and rotatable about said rotary shaft and having polarities alternately different form each other, said rotating disk being interposed between said fixed magnets and said rotatable magnets; an adjusting mechanism for selectively rotating said rotatable magnets, thereby arranging said rotatable magnets between a position completely facing said fixed magnets so that the polarities of said rotatable magnets are the same as those of said fixed magnets faced and a position completely facing said fixed magnets so that the polarities of said rotatable magnets are different from those of said fixed magnets face; and a casing for receiving the rotating metal disk and the permanent magnets, the casing having a circumference portion, said openings, said through holes and said alternating convex and concave portions cooperating to apply a small degree of air resistance to said rotating disk during the rotation thereof.

2. A resistance applying means for an exercising apparatus according to claim 1 further comprising a manual operation member on said casing for operation said adjusting mechanism.

3. A resistance applying means for an exercising apparatus according to claim 1, wherein one end of said rotary shaft is fixed to said rotating disk and another end of said rotary shaft is provided with a flywheel for smoothing the rotation of said rotating disk.

* * * * *